United States Patent [19]

Thatch

[11] 4,197,573

[45] Apr. 8, 1980

[54] SIZE ADJUSTABLE DROP LIGHT CONSTRUCTION

[76] Inventor: Stephen M. Thatch, 1903 Reese Rd., Columbus, Ga. 31907

[21] Appl. No.: 925,044

[22] Filed: Jul. 17, 1978

[51] Int. Cl.[2] ..... F21V 1/00

[52] U.S. Cl. ..... 362/241; 362/250; 362/297; 362/346; 362/396; 362/430

[58] Field of Search ..... 362/237, 241, 297, 250, 362/346, 396, 418, 430

[56] References Cited

U.S. PATENT DOCUMENTS

| | | | |
|---|---|---|---|
| 3,601,598 | 8/1971 | Horn | 362/418 |
| 3,808,420 | 4/1974 | Gortner | 362/396 |

*Primary Examiner*—Stephen J. Lechert, Jr.

*Attorney, Agent, or Firm*—Harold C. Hogencamp

[57] ABSTRACT

A drop light assembly, particularly, for use on automotive vehicles which includes a hollow frame; a retractable and rotatable hook at each end of the frame, at least one of the hooks being connected through a spring to a center post in the frame and lamp sockets fitted with reflective shields mounted on the underside of the frame near each end.

2 Claims, 4 Drawing Figures

SIZE ADJUSTABLE DROP LIGHT CONSTRUCTION

FIELD OF THE INVENTION

This invention relates generally to a drop light assembly adapted to be detachably mounted transversely of a vehicle or other area to be lighted.

DESCRIPTION OF THE PRIOR ART

The prior art, as exemplified by U.S. Pat. Nos. 3,809,883; 2,783,367; 3,340,392; 3,835,317; and 4,019,047 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in a drop light assembly, particularly, for use on automotive vehicles which includes a hollow frame; retractable and rotatable hooks at at least one end of the frame, at least one of the hooks being connected through a spring to a center post in the frame and lamp sockets fitted with reflective shields mounted on the underside of the frame near each end.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
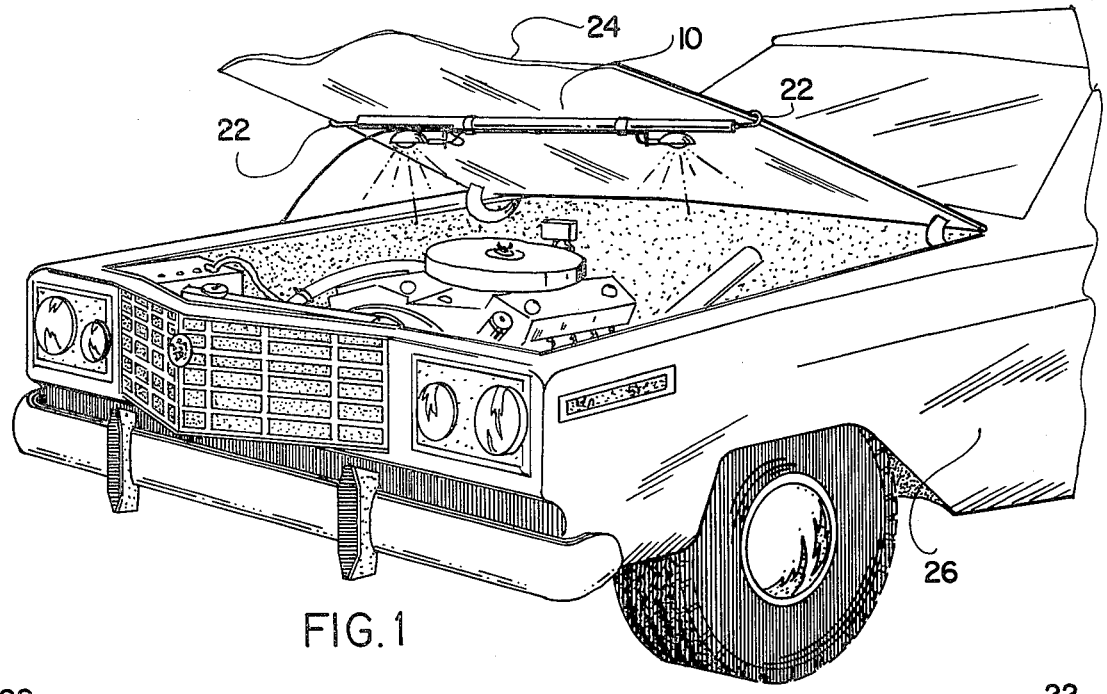
FIG. 1 is a view in perspective showing the assembly of the invention in use under a vehicle hood.
Figure 2:
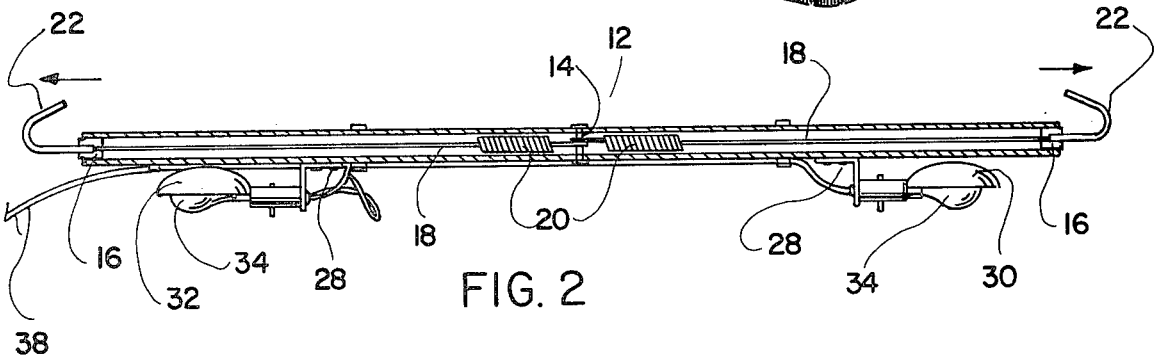
FIG. 2 is a sectional view through the assembly.
Figure 3:
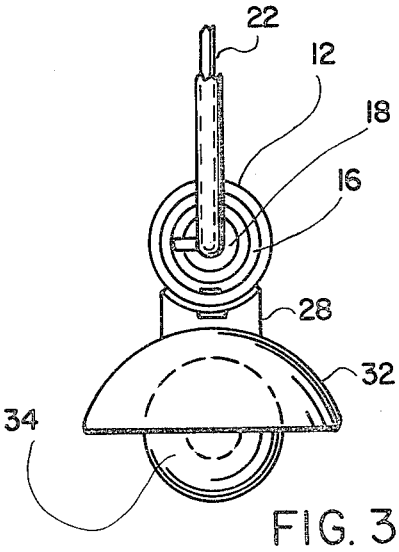
FIG. 3 is an end view of same.
Figure 4:
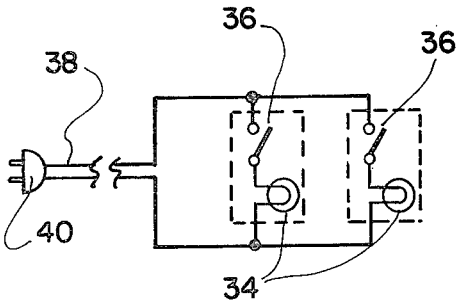
FIG. 4 is a circuit diagram for the assembly.

With reference to the drawing, there is shown and illustrated a drop light mount assembly constructed in accordance with the principles of the invention and designated generally by reference character 10. The illustrated tangible embodiment of the invention includes a hollow metal frame 12 suitably fiftyone inches long, at the center of which is fixed a post or pin 14. Frame 12 can be of the same construction as a typical shower rod one inch in diameter. An end plug 16 having a central bore therein is fitted at each end of frame 12 and allows passage therein and rotation of the end of rods 18 secured at their inward ends to springs 20. These springs suitably are six inches long and one-half inch diameter whose inward ends are both secured to post 14. As shown, the outward ends of the rods 18 are bent to form hooks 22 for securing the frame 12 to any convenient place such as the ends of hood 24 of vehicle 26, usually transversely of a vehicle.

A pair of L-shaped brackets 28 are fixed to the bottom of frame 12 by welding, riveting or by any other suitable means. Mounted on brackets are lamp sockets 30 holding reflective light shields 32. Sockets 30 receive bulbs 34 which preferably are rated sixty watts. Preferably sockets 30 have independent switches 36 and are connected in series with power cord 38.

Power cord 38 has a plug 40 which can be inserted in a house current outlet or, in a modification, in the cigarette lighter outlet.

While two retractable hooks have been shown, only one need be retractable and the other can be stationary. The assembly can be used also for home repairs.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A size adjustable drop light assembly comprising an elongated hollow frame; hook retractably and rotatably mounted at each end of said frame; spaced brackets fixed to said frame and facing in opposite directions; sockets fixed to said brackets, light bulbs in said sockets and shields mounted on said sockets over said bulbs to direct light away from said frame.

2. The invention as recited in claim 1, including a post fixed in the center of said frame and springs secured at their inward end to said post and at their outward ends to said hooks.

* * * * *